United States Patent [19]

McKinzie

[11] 4,127,466

[45] Nov. 28, 1978

[54] PHOTOELECTROCHEMICAL METAL PLATING AND PURIFICATION SYSTEM

[75] Inventor: Howard McKinzie, Framingham, Mass.

[73] Assignee: GTE Laboratories Incorporated, Waltham, Mass.

[21] Appl. No.: 850,926

[22] Filed: Nov. 14, 1977

[51] Int. Cl.[2] ..... C25C 1/00; C25C 7/00

[52] U.S. Cl. ..... 204/248; 204/45 R; 204/52 R; 204/52 Y; 204/105 R; 204/DIG. 3; 429/111

[58] Field of Search ..... 204/45 R, 52 R, 52 Y, 204/59 R, 105 R, DIG. 3, 248; 429/111

[56] References Cited

U.S. PATENT DOCUMENTS

Re. 19,218 6/1934 Ruben ..... 429/111

FOREIGN PATENT DOCUMENTS 1,435,896 5/1976 United Kingdom ..... 204/DIG. 3

OTHER PUBLICATIONS

A. Fujishima et al., "Electrochemical Evidence for the Mechanism of the Primary State of Photosynthesis", *Bull. Chem. Soc. Japan,* vol. 44, 1148 (1971).

M. S. Wrighton et al., "Photoassisted Electrolysis of Water by Irradiation of a Titanium Dioxide Electrode", *Proc. Nat. Acad. Sci. USA,* vol. 72, 1518 (1975).

S. N. Frank et al., "Semiconductor Electrodes IZ. Photoassisted Oxidations and Photoelectrosynthesis at Polycrystalline $TiO_2$ Electrodes", *J. Am. Chem. Soc.* vol. 99, p. 4667 (1977).

J. A. Baglio et al., "Catalysis Research at GTE Labs", *GTE Labs. Profile,* Issue 4, Dec. 1976.

H. Gerischer "On the Stability of Semiconductor Electrodes Against Photo-decomposition", *J. Electroanalytical Chem.,* vol. 82, pp. 133–143 (1977).

R. A. L. Vanden Berghe et al., "A Comparative Study of Electron Injection Into ZnO, CdS & CdSe Single Crystal Anodes", *Ber. Bunsen Physik Chem.* vol. 76, pp. 481–485 (1972).

E. C. Dutoit et al., "Electrochemical Properties of the Semiconducting $TiO_2$ (Rutile) SIngle Crystal Electrode", *Ber. Bunsen Physik Chem.* vol. 80, pp. 475–481, (1976).

L. A. Harris et al., "Corrosion Suppression or Rutile Anodes by High Energy Redox Reactions", *J. Electro Chem. Soc.,* vol. 124, pp. 839–844 (1977).

C. Menezes et al., "Photoelectronic Properties of CdTe-Electrolyte Heter junctions: Feazibility as Solar Energy Converters", *Appl. Phys. Lett.* vol. 31, pp. 16–18 (1977).

*Primary Examiner*—John H. Mack
*Assistant Examiner*—Aaron Weisstuch
*Attorney, Agent, or Firm*—David M. Keay

[57] ABSTRACT

A photoelectrochemical metal plating and purification process includes at least one electrolyte containing a reduction-oxidation couple, one species of which is a metal cation which can be reduced to elemental metal at an electrode. The system includes an N-type photosensitive semiconductor electrode at which, under illumination, an oxidation reaction occurs, with concurrent reduction of the metal cation at the counter electrode. In operation, one ionic species of the electrolyte is oxidized while metal ions are reduced and collected as the elemental metal at the counter electrode. In cases where the elemental metal is liquid at the operation temperature, it is collected as a liquid metal pool under the counter electrode.

5 Claims, 2 Drawing Figures

PHOTOELECTROCHEMICAL METAL PLATING AND PURIFICATION SYSTEM

BACKGROUND OF THE INVENTION

The present invention relates to a metal plating and purification process and more particularly to a photoelectrochemical metal plating and purification process capable of converting light energy directly to chemical energy and utilizing this energy to electro-deposit metals at a suitable electrode.

It has been discovered that water can be photodissociated into hydrogen and oxygen at very low electrical potentials by using titanium dioxide or other semiconductor electrodes and a light source rich in energy in the ultraviolet region of the electromagnetic spectrum. This discovery has opened a new area of research into the conversion of solar energy into stored chemical energy. For example, hydrogen generated by the photodissociation of water can be stored for later use either as the gas per se, or as a metal hydride.

Other uses for solar energy utilizing these semiconducting electrodes involve the direct conversion of light energy into chemical energy for purposes of driving other chemical reactions.

SUMMARY OF THE INVENTION

The present invention is a photoelectrochemical process for the plating and purification of metals. The invention solves the problem of high energy usage from conventional sources in presently known plating operations by utilizing solar energy collected by any of several semiconducting electrodes.

The photoelectrochemical metal plating system employs an electrolyte containing the constituents of a reduction-oxidation couple, one component of which is the metal sought to be plated or purified. The source of energy for the plating process includes a photoactive semiconducting electrode immersed in the electrolyte. The photoactive electrode responds to light of appropriate wavelengths to drive the reduction-oxidation reactions which result in the plating of metal on the counter electrode. An interruptable electrical current conductor is connected in series between the photoactive electrode and the counter electrode. The metal resulting from the reduction-oxidation reaction is collected on the counter electrode of, if it is a liquid at the operation temperature, in a pool below the counter electrode.

DESCRIPTION OF THE DRAWING

While the Specification concludes with claims particularly pointing out and distinctly claiming that which is regarded as the present invention, details of the preferred embodiments of the invention may be more readily ascertained from the following detailed description when read in conjunction with the accompanying drawing wherein:

DETAILED DESCRIPTION

Figure 1:
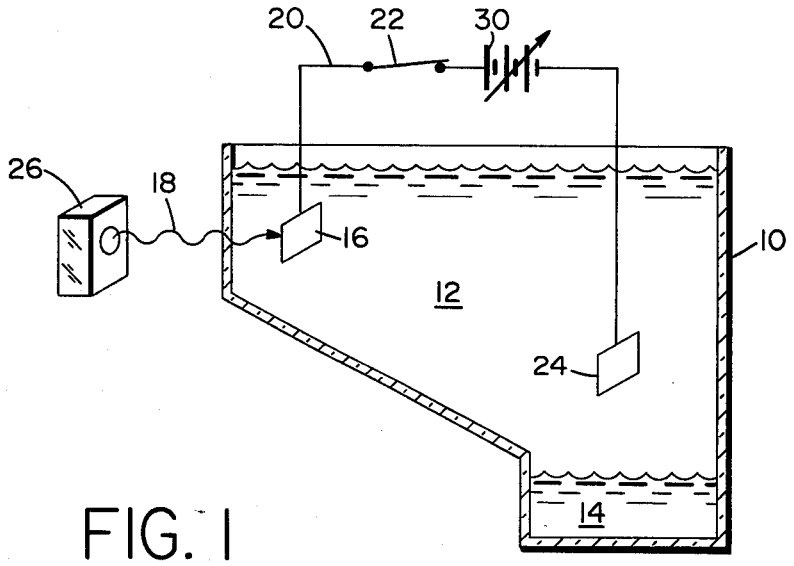
FIG. 1 is a schematic representation of a photoelectrochemical plating and purification cell constructed in accordance with the present invention.
Figure 2:
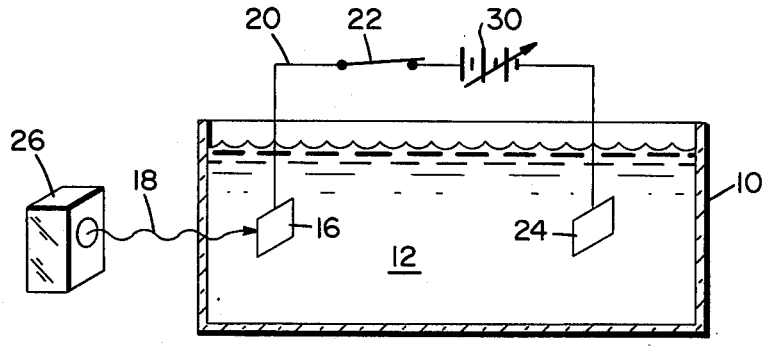
FIG. 2 is a schematic representation of an alternate embodiment of a photoelectrochemical cell constructed in accordance with the present invention.

Referring to FIGS. 1 and 2, a photoelectrochemical plating and purification cell constructed in accordance with the present invention includes a fluid tight container 10 for a solution 12 which contains the components of a metal plating bath.

The system includes a photoactive electrode 16 immersed in solution 12. Electrode 16 is exposed to a source of light from light source 26 rich in wavelengths in the ultraviolet region of the spectrum, which may be prefocussed and which is indicated by the serpentine arrow 18. When the system is active, electrode 16 is short-circuited through connection 20 and switch 22 to a second electrode 24 immersed in solution 12 at some distance from electrode 16.

Electrode 16 is coated with a material which when subjected to light, is capable of supporting a particular oxidation reaction in the vicinity of the electrode. Electrons liberated by the oxidation reaction leave the solution 12 through electrode 16, flowing through connection 20, switch 22, and variable direct current source 28, to electrode 24. At electrode 24 these electrons re-enter solution 12 to support a reduction reaction which converts metal ions in solution 12 to elemental metal.

With some photoactive materials used to coat electrode 16, it may become necessary to apply a small biasing potential, usually of the order of 0.1 to 0.2 volts to make electrode 16 positive with respect to electrode 24. This is accomplished by placing a variable direct current source in series electrical connection with electrodes 16 and 24.

If the elemental metal produced at electrode 24 is a liquid at operating temperature, it is collected in sump 14 below electrode 24. If the elemental metal produced by the reduction reaction occurring at electrode 24 is a solid at operating temperature, it will be plated out on electrode 24, in which case there is no need for the sump 14 and the container 20 will appear as in the alternate embodiment of the invention represented schematically in FIG. 2.

In one embodiment of the invention, solution 12 is an aqueous solution including an ionizable metal salt and its corresponding acid. Specific metal salts and acids considered to be suitable are set forth below. Electrode 16 is coated with a photoactive semiconductor material such as titanium dioxide which, when subjected to light of appropriate wavelengths, is capable of photodissociating water in the vicinity of the electrode. Semiconductor materials which may be used in place of titanium dioxide are set forth below.

When photodissociation of water occurs, oxygen evolves from solution 12 and hydrogen ions are produced. The electrons which are liberated by this process leave solution 12 through electrode 16 and are conducted to electrode 24. The electrons, re-entering solution 12 at electrode 24, combine with metal cations in solution to produce elemental metal at the electrode. If the electrolyte solution contains a mercury compound, elemental mercury is precipitated from the solution and may be collected in a sump 14. Other metals, such as copper, will not necessarily precipitate from solution but instead may adhere to electrode 24 as a coating. Thus, in this embodiment, energy which originally enters the system as radiant energy is used to form an elemental metal by reduction of the corresponding metal cation.

As the reaction proceeds, the solution becomes more acidic due to the increase of the concentration of hydrogen ion generated by the photodissociation of water. More of the metal or its compound can then be dissolved in the acid solution to replenish the metal cation concentration depleted by plating.

DESCRIPTION OF THE PREFERRED EMBODIMENTS

The photoelectrochemical reactions which occur in the preferred embodiments of this invention are illustrated with reference to specific metal salts, acids, and semiconductor electrode materials below.

In one embodiment, the metal salt is mercury (II) perchlorate and the acid is perchloric acid. The photodissociation reaction which occurs at elctrode 16 in the presence of ultraviolet light ($h\nu$) can be written as:

$$H_2O \xrightarrow{h\nu} \tfrac{1}{2} O_2 + 2H^+ + 2e^-$$

while the reduction reaction which occurs at electrode 24 can be written as:

$$Hg^{++} + 2e^- \rightarrow Hg^o.$$

The overall net reaction in the system for this embodiment of the invention therefore is:

$$H_2O + Hg^{++} \xrightarrow[HClO_4]{h\nu} \tfrac{1}{2} O_2 + Hg^\circ + 2H^+.$$

Other anions are also suitable.

In another embodiment, copper (II) sulfate serves as the dissolved metal salt in a solution also containing sulfuric acid. The photodissociation reaction occurring at electrode 16 remains the same as that described above. At electrode 24, the reaction which occurs can be written as:

$$Cu^{++} + 2e^- \rightarrow Cu^o$$

Photoactive semiconductor electrode materials envisioned as being suitable for coatings on electrode 16 include titanium (IV) oxide ($TiO_2$), strontium titanate ($SrTiO_3$), potassium tantalate ($KTaO_3$), tin (IV) oxide ($SnO_2$), iron (III) oxide ($Fe_2O_3$), cadmium telluride (DdTe), and the material designated by the formula $KTa_{0.77}Nb_{0.23}O_3$.

Critical requirements for the choice of photoactive semiconductor electrode materials include the possession by the material of a sufficiently broad electronic energy band gap to encompass the energy of reduction-oxidation couples employed by the plating and purification system. However, the electronic energy band gap of the photoactive semiconductor material must be narrow enough to lie within the range excitable by visible or ultraviolet light. Wavelengths of light considered "actinic" for this system thus vary with the choice of photoactive semiconductor material, and consist of those wavelengths of sufficient energy to excite electrons from the valence electronic energy band to the condition band within the semiconductor material of choice.

With some semiconductor materials it may be necessary to apply a small potential, usually of the order of 0.1 to 0.2 volts to bias the photoactive electrode positively with respect to the second electrode. This potential serves to make electron transfer at the photoactive electrode surface more efficient, and need never be large enough to drive the reduction-oxidation reaction at the two electrodes in the absence of illumination.

Critical considerations for the choice of chemical constituents of the plating solution 12 include the requirement that the oxidation and reduction potentials for the overall chemical reactions must lie within the band gap of the semiconductor material, or be adjustable to a value lying in that range by variation of other parameters such as solution pH, temperature, or concentration, or the application of a small biasing potential to the electrode system. In addition, the reaction must be reversible.

EXAMPLE I

A 1 $cm^2$ $TiO_2$ electrode was immersed in a solution of 0.5 M $Hg(NO_3)_2$ and electrically connected to a 2$cm^2$ platinum counter electrode. The $TiO_2$ electrode was illuminated with light from a 150 watt high pressure xenon lamp, the light passing through 10 cm of water to remove infrared wavelengths, and then through a quartz lens to focus it upon the electrode. Upon illumination, oxygen was immediately generated at the $TiO_2$ electrode and, after a few minutes operation, mercury drops were observed on the platinum electrode in the container beneath the platinum electrode.

EXAMPLE II

An experiment was conducted which was similar to Example I in every regard with the exception that the electrolyte solution contained 0.5 M $CuSO_4$ instead of mercury (II) nitrate. After one hour of illumination, copper was observed on both the $TiO_2$ and platinum electrodes. The experiment was repeated after applying a potential of 0.1 volt to the electrodes such that the $TiO_2$ electrode was positively biased with respect to the platinum electrode. After 1 hour of illumination, no copper was observed on the $TiO_2$ electrode, but 0.7 milligrams of copper were found to be deposited on the platinum electrode.

EXAMPLE III

A further experiment was conducted in a two compartment container. One compartment contained 0.5 M $CuSO_4$ solution and a platinum electrode. This electrode was electrically connected through a potentiostat to a $TiO_2$ electrode in a second compartment which also contained a solution of 0.5 M $Na_2SO_4$ with sufficient sulfuric acid to adjust the pH to a value of 3.6, identical with that in the copper (II) sulfate compartment. When the $TiO_2$ electrode was illuminated with a light source as described in Example I, a current of 0.8 milliamps was observed and, after 1 hour, 0.8 milligrams of copper had collected on the platinum electrode. No copper was observed on the $TiO_2$ electrode.

The specific examples given above call for the use of aqueous electrolytes and $TiO_2$ as the semiconductor material. The use of non-aqueous electrolytes and semiconductor electrode materials other than $TiO_2$, such as those listed above, are also considered to be within the scope of this invention. There are, in fact, particular advantages to using non-aqueous electrolytes.

For example, the potential of the working reduction-oxidation couple in aqueous electrolytes is limited to 1.23 volts by the dissociation energy of water. Some non-aqueous electrolytes such as those based on acetonitrile have reduction-oxidation potentials of 5.0 volts or greater. The choice of such non-aqueous systems permits the plating and purifying of metals with much larger potentials than those suitable for aqueous electrolytes. In the case of non-aqueous electrolytes it is also possible to use photoactive semiconductor electrode materials which are not suitable in aqueous medium.

While there has been shown and described what is at present considered the preferred embodiments of the invention, it will be obvious to those skilled in the art that various changes and modifications may be made therein without departing from the scope of the invention as defined by the appended claims.

What is claimed is:

1. A photoelectrochemical metal plating and purification system comprising an electrolyte containing a reduction-oxidation couple, one component of said couple consisting of the cation of a metal to be plated or purified, a photoactive electrode coated with a photoactive semiconductor material immersed in said electrolyte, said photoactive semiconductor material responding to actinic radiation to establish an oxidation reaction at said photoactive electrode, said photoactive electrode electrically connected to a second electrode immersed in said electrolyte at some distance from said photoactive electrode, a reduction reaction being established at said second electrode complementary to said oxidation reaction at said photoactive electrode whereby said metal cations are reduced to elemental metal at said second electrode, and a means for directing actinic radiation on said photoactive electrode.

2. The photoelectrochemical metal plating and purification system of claim 1 wherein said photoactive semiconductor material is selected from the group consisting of titanium (IV) oxide, tin (IV) oxide, iron (III) oxide, cadmium telluride, strontium titanate, potassium tantalate, and the material designated by the formula $KTa_{0.77}Nb_{0.23}O_3$.

3. The photoelectrochemical metal plating and purification system of claim 1 wherein said photoactive semiconductor material is titanium (IV) oxide.

4. The photoelectrochemical metal plating or purification system of claim 1 wherein said metal to be plated or purified is copper.

5. The photoelectrochemical metal plating and purification system of claim 1 wherein said metal to be plated or purified is mercury.

* * * * *